US007677927B2

(12) United States Patent
Hermant et al.

(10) Patent No.: US 7,677,927 B2
(45) Date of Patent: Mar. 16, 2010

(54) HIGH BANDWIDTH CONNECTOR

(75) Inventors: Stéphane Hermant, Etampes/Marne (FR); Gilles Rouchaud, Montmirail (FR)

(73) Assignee: Axon'Cable, Montmirail (FR)

( * ) Notice: Subject to any disclaimer, the term of this patent is extended or adjusted under 35 U.S.C. 154(b) by 0 days.

(21) Appl. No.: 12/298,024

(22) PCT Filed: Apr. 20, 2007

(86) PCT No.: PCT/FR2007/051144

§ 371 (c)(1),
(2), (4) Date: Nov. 17, 2008

(87) PCT Pub. No.: WO2007/122350

PCT Pub. Date: Nov. 1, 2007

(65) Prior Publication Data

US 2009/0104819 A1 Apr. 23, 2009

(30) Foreign Application Priority Data

Apr. 21, 2006 (FR) ..... 06 51397

(51) Int. Cl.
*H01R 13/648* (2006.01)

(52) U.S. Cl. ..... 439/607.46; 439/76.1

(58) Field of Classification Search ..... 439/607.41, 439/607.42, 607.45, 607.46, 607.47, 607.48, 439/607.49, 607.5, 607.51, 607.52, 76.1, 439/497

See application file for complete search history.

(56) References Cited

U.S. PATENT DOCUMENTS

| | | | | |
|---|---|---|---|---|
| 5,364,292 | A | 11/1994 | Bethurum | |
| 6,257,924 | B1 | 7/2001 | Lund | |
| 6,336,827 | B1 * | 1/2002 | Akama et al. | 439/607.46 |
| 6,582,252 | B1 * | 6/2003 | Lin | 439/607.46 |
| 6,663,415 | B1 * | 12/2003 | Wu | 439/460 |
| 7,351,096 | B2 * | 4/2008 | Kondou et al. | 439/497 |
| 7,438,565 | B2 * | 10/2008 | Hamazaki | 439/108 |
| 2004/0115988 | A1 | 6/2004 | Wu | |
| 2005/0181670 | A1 * | 8/2005 | Kumamoto et al. | 439/607 |

FOREIGN PATENT DOCUMENTS

| | | | |
|---|---|---|---|
| EP | 0 520 283 | A1 | 12/1992 |
| WO | WO 03/073557 | A | 9/2003 |

* cited by examiner

*Primary Examiner*—Ross N Gushi
(74) *Attorney, Agent, or Firm*—Kenyon & Kenyon LLP

(57) ABSTRACT

Male or female connector having at least one pair of pins for a two-wire, high-speed link. The connector comprises two parallel pins, an insulating insert, a metal casing and a connection printed circuit.

18 Claims, 2 Drawing Sheets

HIGH BANDWIDTH CONNECTOR

This is a 371 national phase application of PCT/FR2007/051144 filed 20 Apr. 2007, which claims priority to French Patent Application No. FR 06/51397 filed 21 Apr. 2006, the contents of which are incorporated herein by reference.

FIELD OF THE INVENTION

The invention relates to a connector capable of being used in cable links that are high speed and designed to apply a minimum of interference to the signals transferred. The invention also relates to a pair of connectors, respectively of the male and female type, capable of interacting in a satisfactory manner in a high speed link.

BACKGROUND OF THE INVENTION

When it is desired to produce digital links comprising cables capable of carrying digital information at high speed (typically more than 100 Mbits/s) there is the problem of connecting such a cable, either to another similar cable, or to an electronic processing system, with the aid of powerful connectors designed not to adversely affect the quality of the transmitted signals. A shielded, two-wire transmission line, usually recommended for such signals, requires specific, high-performance connectors. They must for example provide good protection against external electromagnetic interference. They must also interfere as little as possible with the predetermined constant impedance of the transmission lines. It should be noted that shielded, two-wire cables used for these high speed links have a constant, characteristic impedance, for example of 100 ohms. The connector must be designed so that this impedance does not vary significantly at the coupling. The cables must notably be coupled, for example by soldering, in a sufficiently simple, reliable and repetitive manner, without requiring a particular skill of the technician responsible for assembling the cable and the connector, typically by solders.

SUMMARY OF THE INVENTION

The invention makes it possible to achieve these objectives, notably the coupling at constant impedance.

More particularly, the invention relates to a connector suitable for at least one two-wire, high-speed, shielded transmission line with a predetermined constant impedance, characterized in that it comprises in combination:

- two parallel pins,
- an insulating insert in which said pins are mounted,
- a metal casing comprising a sleeve open at one of its ends, said sleeve housing said insert and said pins, and
- a connection printed circuit installed in said casing, coupled to said pins and configured to control the connection geometry of said two-wire line in said casing.

The type of connector defined above may advantageously be obtained by an appropriate modification of a connector satisfying the MIL standard DTL 83513. This standard defines a type of connector known in the prior art as a "micro-D" connector.

Notably, the polarization is obtained by the D-shape of the metal sleeve of the casing of the connector, housing the pins.

The printed circuit mentioned above makes it possible to couple the shielded cables while complying with the impedance-matching, particularly the separation of the two wires and making the soldered connections easy.

Advantageously, said printed circuit included in the casing comprises two parallel tracks, substantially in the extension of the two pins. The latter are respectively coupled to first ends of these two tracks while the ends of the two-wire line (the cores of the two shielded wires) are designed to be soldered to second ends of these two tracks, respectively.

According to another advantageous feature, said printed circuit comprises a third track perpendicular to said two parallel tracks and in the vicinity of said second ends of the latter, for the coupling of the or each sheath for shielding said shielded two-wire line.

A ground plane may advantageously be provided on the other face of the printed circuit to obtain the designed impedance between the two parallel tracks.

The invention also relates to a pair of connectors, each according to the preceding description, one comprising at least one pair of male pins and the other comprising at least one pair of female pins.

Advantageously, and in a manner known per se, one of the connectors comprises an aforementioned metal sleeve called "outer sleeve", of larger section than that of the corresponding metal sleeve of the other connector called the "inner sleeve", so as to slide along the latter, when the two connectors are coupled.

According to another advantageous feature, said outer sleeve is sufficiently long for its free end to come into electrical contact with a socket of the connector comprising said inner sleeve. This considerably enhances the quality and continuity of the protective shielding against the external electromagnetic fields, obtained by assembling the two casings. The quality of the electrical contact is ensured by a mechanical locking between the two casings, after electrical coupling, preferably by means of screws and nuts.

BRIEF DESCRIPTION OF THE DRAWINGS

The invention will be better understood and other advantages of the latter will appear more clearly in the light of the following description, given only as an example and made with reference to the appended drawings in which.

DETAILED DESCRIPTION

Figure 1:
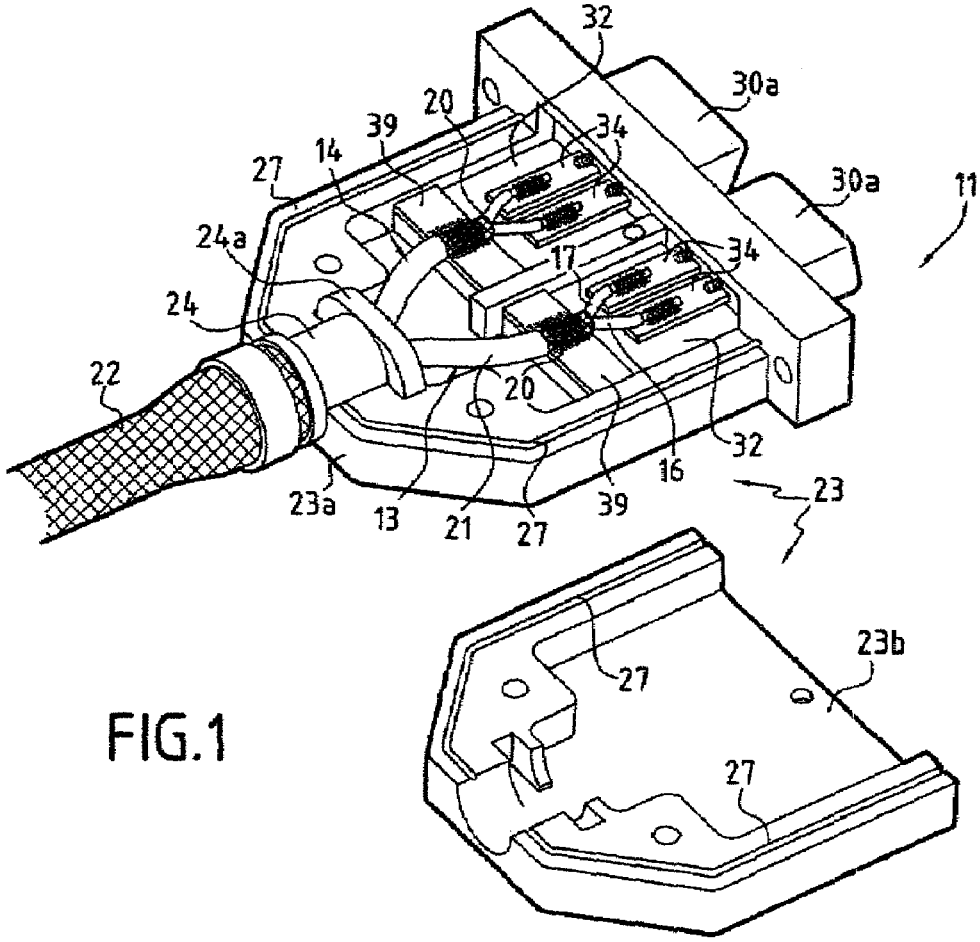
FIG. 1 is a view in perspective of a two-wire, two-channel connector, according to the invention, the casing of this connector being open.

FIG. 1 represents a connector 11 making it possible to couple two high-speed, two-wire transmission lines 13, 14. This connector is capable of being coupled either to a similar connector, for example in order to extend said lines, or to a fixed connector, installed in an electronic apparatus processing data carried by these lines.

According to the example, each transmission line 13, 14 consists of a conventional cylindrical shielded cable enclosing two insulated conductor wires 16, 17 mounted in a twisted manner in a common braided metal sheath 20. The sheath is itself surrounded by an insulating sleeve 21. The drawings illustrate the connectors already coupled to the transmission lines.

The two shielded cables are themselves surrounded by a metal braid 22 electrically connected to the metal casing 23 of the connector by means of a metal tube 24 comprising a shoulder 24*a* engaged in a recess of the casing. The braid is swaged onto this tube.

Each shielded, two-wire transmission line 13, 14 described above has a predetermined constant impedance, for example of 100 ohms.

As can be see in FIG. 1, the metal casing 23 consists of two assembled portions, a first portion 23*a* supporting the interconnection components and a second portion 23*b* forming a cover.

For each two-wire line, the connector comprises:

- two parallel pins (which may be male pins 25*a* or female pins 25*b*)
- an insulating insert 26*a* or 26*b* in which said pins are mounted,
- a metal sleeve 30*a* or 30*b* (forming part of said first portion of the casing) open at one of its ends and housing said insert and said pins.

Figure 2:
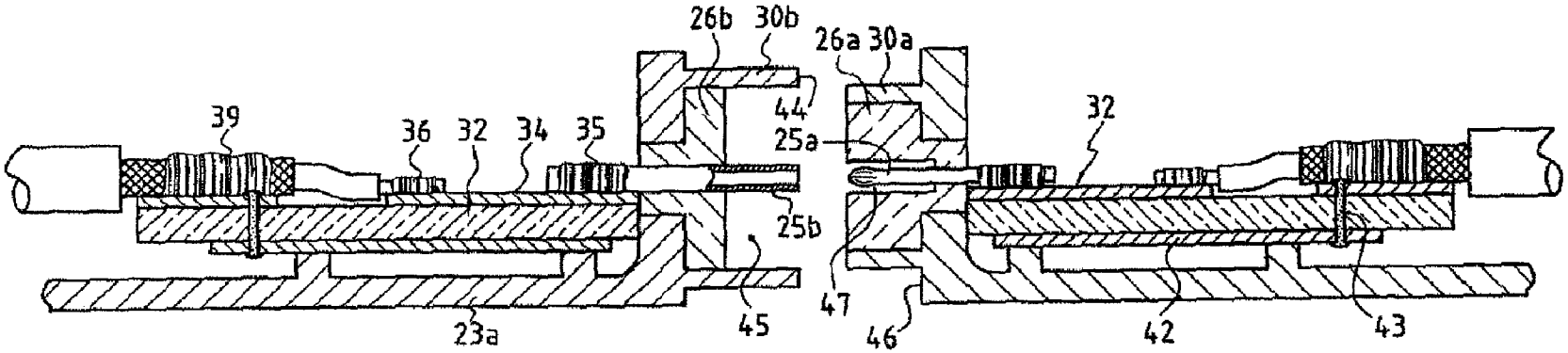
FIG. 2 is a schematic view in section illustrating a pair of connectors, with male and female pins, according to the invention, before coupling.
Figure 3:
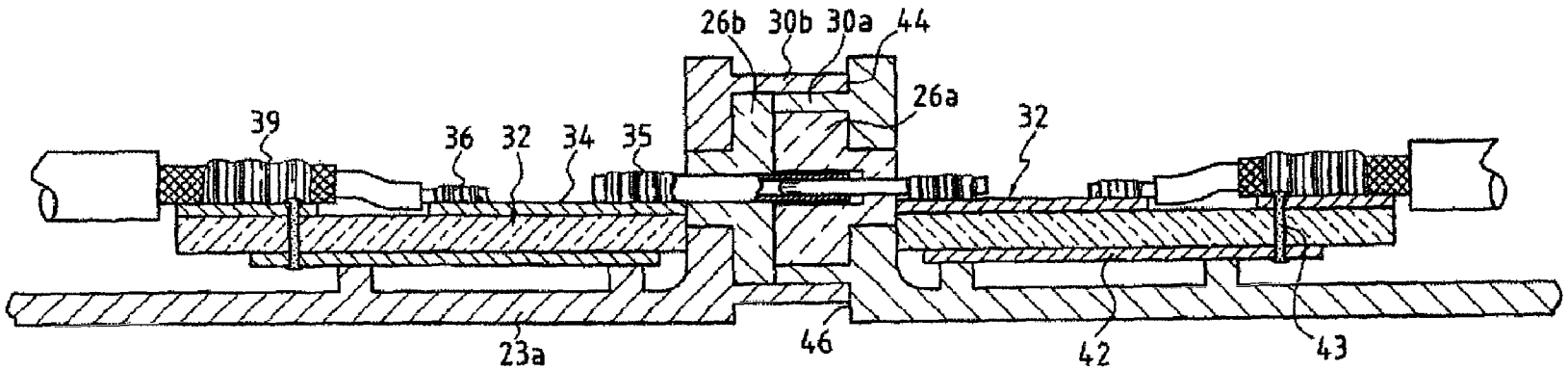
FIG. 3 is a view similar to FIG. 2 illustrating the two connectors after coupling.

These elements are clearly visible in FIGS. 2 and 3.

In addition, the casing 23 houses (for each two-wire line) a connection printed circuit 32 placed between said pins 25*a* or 25*b* installed in a sleeve 30*a* or 30*b* and said corresponding shielded, two-wire transmission line.

The structure of this connection printed circuit 32 makes it easier to couple the shielded cable. It also makes it possible to control the geometry of the two-wire line through said casing, that is to say between the cable and the two corresponding parallel pins.

Each sleeve 30*a* or 30*b* houses an insert 26*a* or 26*b* which comprises only two parallel pins.

In the example of FIG. 1 in which the connector is designed for the coupling of two two-wire lines, the casing comprises two sleeves 30*a* and consequently houses two inserts 26*a* (situated in the sleeves) and two printed circuits 32. Each printed circuit comprises two parallel tracks 34 arranged substantially in the extension of the two pins 25*a* and said pins are respectively coupled to first ends 35 of these two tracks. The ends of the two-wire line 13 or 14 may therefore be soldered to second ends 36 of these two tracks, respectively. In addition, the printed circuit comprises a third track 39 perpendicular to said two parallel tracks and in the vicinity of said second ends 36 of the latter. This third track makes it possible to connect the shielding sheath 20, by a simple solder.

The arrangement of the two parallel tracks 34 and of said third track 39 perpendicular to the latter makes the cabling of the two-wire line easier, as shown. In addition, the printed circuit is mounted in a housing defined in said first portion of the casing 23*a*, immediately next to the rear ends of said pins 25*a* or 25*b* and the latter are directly soldered to said parallel tracks. The dielectric characteristics of the insert 26*a* or 26*b* and of the insulating support of the printed circuit 32 and the distance separating the pins and the two parallel tracks influence as small as possible a characteristic impedance variation in the connector.

The outer shielding formed both by the braid 22 and by the structure of the metal casing 23 protects the two-wire transmission lines from the external electromagnetic radiation and from the possible interference due to these lines. The two portions 23*a* and 23*b* comprise grooves 27 making it possible to install seals (not shown). These elastomer seals may be filled with conductive material to increase the effectiveness of the shielding.

In the example shown, each printed circuit 32 is of the two-sided type so that it comprises a ground plane 42 extending substantially over the whole of its surface. This ground plane is defined on the other side of the printed circuit; it therefore extends parallel to said tracks 34, 39.

Said third track 39 is connected to the ground plane 42, for example via a join 43 or a plated through-hole extending through the insulation of the printed circuit. The ground plane is, in this example, connected to the metal casing 23.

At least one and preferably each metal sleeve 30*a* or 30*b* defined in said first portion of the casing has a polarizing contour. In the example specifically described, said contour is D-shaped, known per se. If the connector comprises several sleeves in line, two adjacent sleeves have their contours inverted (see FIGS. 4 and 5) which makes it possible to reduce the width of the connector.

In a connector according to the invention, the two pins may be of the male or female type and, naturally, the invention also relates to a pair of connectors, each according to the foregoing description, in which one connector comprises a pair of male pins 25*a* arranged in the or each sleeve 30*a* of the corresponding metal casing and the other connector comprises a pair of female pins 25*b* arranged in the or each sleeve 30*b* of the other metal casing (FIGS. 2 and 3).

Advantageously, one of the connectors comprises at least one aforementioned metal sleeve called the outer sleeve, (the sleeve 30*b* in this instance) with a larger section than that of the or each sleeve, called the inner sleeve (the sleeve 30*a* in this instance), of the other connector, so as to slide along the latter when the two connectors are coupled. This is more particularly illustrated in FIGS. 2 and 3.

In addition, according to an advantageous feature of the invention, the outer sleeve 30*b* is sufficiently long for its free end 44 to come into electrical contact with a socket 46 of the connector comprising the inner sleeve 30*a* (FIGS. 2 and 3).

It should be noted that, with reference to the MIL standard DTL 83513 defining the general architecture of a "micro D" connector, the latter does not promote this end electrical contact.

Said end electrical contact, made possible and consolidated by screws for assembling the two connectors, considerably enhances the electromagnetic compatibility (EMC or "RFI/EMI protection") of the high-speed connection.

In this embodiment, the female pins 25*b* protrude from the corresponding insert 26*b* into an open cavity 45 delimited by the sleeve 30*b* which surrounds them. The latter is the outer sleeve.

In addition, the male pins 25*a* are fully integrated into the corresponding insert 26*a* of the sleeve 30*a* and the latter is the inner sleeve. As can be seen in FIG. 2, each male pin 25*a* extends axially into a hole 47 of the insert 26*a* and the diameter of this hole is just sufficient to accommodate the corresponding female pin 25*a* of the other connector.

This arrangement is advantageous, but it is perfectly possible to design a converse structure in which the male pins protrude from the corresponding insert and the female pins are fully incorporated into their own insert.

Naturally, the male pins could be housed in an "outer" sleeve and the female pins could be housed in an "inner" sleeve.

The connector shown in FIG. 1 is of the two-channel type, that is to say that it is suitable for simultaneously connecting two two-wire transmission lines. Naturally, the connector according to the invention may be designed for a single channel; it then comprises only one sleeve housing one insert and one pair of pins.

Figure 4:
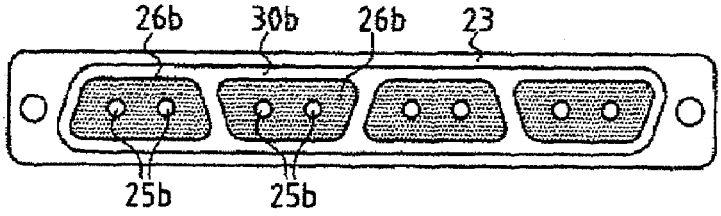
FIG. 4 is an end view of a two-wire, four-channel connector.

Conversely, one and the same connector may comprise a larger number of sleeves, for the simultaneous coupling of a corresponding number of lines. Each sleeve forming part of the same metal casing 23 then houses one insert 26*b* and two pins 25*b*. In the example of FIG. 4, the sleeves are arranged side by side and in a single row.

Outer sleeves 30*b* form only one elongated block. Corresponding inner sleeves, on the other connector not shown, are separate.

Figure 5:
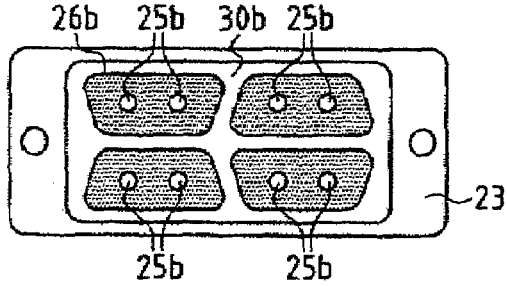
FIG. 5 is an end view of another two-wire, four-channel connector.

This connector provides for the simultaneous connection of four two-wire transmission lines. In the embodiment of FIG. 5, the sleeves are placed side by side and on (at least) two parallel rows. In the example more specifically described with four channels, the sleeves are therefore placed "in a square".

The invention claimed is:

1. A connector suitable for at least one two-wire, high-speed, shielded transmission line with a predetermined constant impedance, comprising in combination:

two parallel pins, an insulating insert in which said pins are mounted, a metal casing comprising at least one sleeve open at one of its ends, said sleeve housing said insert and said pins, and a connection printed circuit installed in said casing, coupled to said pins and configured to control the connection geometry of said two-wire line in said casing, wherein the at least one sleeve comprises a plurality of sleeves arranged in the metal casing, each sleeve housing having an insert and two pins.

2. The connector as claimed in claim 1, wherein said printed circuit comprises two parallel tracks, substantially in the extension of the two pins, and said pins are respectively coupled to first ends of these two tracks and the ends of the two-wire line are capable of being connected, for example soldered, to second ends of these two tracks respectively.

3. The connector as claimed in claim 2, wherein said printed circuit comprises a third track, perpendicular to said two parallel tracks and situated in the vicinity of said second ends of the latter, for the coupling of a sheath for shielding said shielded, two-wire line.

4. The connector as claimed in claim 2, wherein said printed circuit comprises a ground plane on one of its faces, extending parallel to said tracks.

5. The connector as claimed in claim 4, wherein a third track is connected to said ground plane through said printed circuit.

6. The connector as claimed in claim 4, wherein said ground plane is connected to said casing.

7. The connector as claimed in claim 1, wherein said metal casing consists of two assembled portions, a first portion comprising said sleeve -and supporting said insert and said printed circuit and a second portion forming a cover.

8. The connector as claimed in claim 1, wherein said sleeve has a polarizing contour.

9. The connector as claimed in claim 8, wherein said polarizing contour is D-shaped, known per se.

10. The connector as claimed in claim 1, wherein said plurality of sleeves are placed side by side in a single row.

11. The connector as claimed in claim 1, wherein said plurality of sleeves are placed side by side and in at least two parallel rows.

12. A pair of connectors, each as claimed in claim 1, one comprising at least one pair of male pins and the other comprising at least one pair of female pins.

13. The pair of connectors as claimed in claim 12, wherein said female pins protrude from the corresponding insert in an open cavity -delimited by the sleeve that surrounds them.

14. The pair of connectors as claimed in claim 12, wherein said male pins are fully integrated into the corresponding insert.

15. The pair of connectors as claimed in claim 12, wherein one of the connectors comprises an aforementioned metal sleeve called an outer sleeve, of larger section than that of the corresponding sleeve of the other connector, called an inner sleeve, so as to slide along the latter when the two connectors are coupled.

16. The pair of connectors as claimed in claim 15, wherein said inner sleeve is that which houses the male pins and said outer sleeve is that which houses the female pins.

17. The pair of connectors as claimed in claim 15, wherein said outer sleeve is of sufficient length for its free end to come into electrical contact with a socket of the connector comprising the inner sleeve.

18. A pair of connectors, each connector suitable for at least one two-wire, high-speed, shielded transmission line with a predetermined constant impedance, each connector comprising:

two parallel pins, an insulating insert in which said pins are mounted, a metal casing comprising a sleeve open at one of its ends, said sleeve housing said insert and said pins, and a connection printed circuit installed in said casing, coupled to said pins and configured to control the connection geometry of said two-wire line in said casing, wherein one of the pair of connectors comprising at least one pair of male pins and the other connector of the pair of connectors comprising at least one pair of female pins, wherein one of the pair of connectors comprises the casing comprising the sleeve called an outer sleeve, of larger section than that of the corresponding sleeve of the other connector of the pair of connectors, called an inner sleeve, so as to slide along the latter when the pair of connectors are coupled, and wherein said inner sleeve is that which houses the male pins and said outer sleeve is that which houses the female pins.

* * * * *